US008448947B2

(12) United States Patent
McAndrew et al.

(10) Patent No.: US 8,448,947 B2
(45) Date of Patent: May 28, 2013

(54) GAME, METHOD OF PLAY, AND STACKABLE MEMBERS SUCH AS CARDS WHICH MAY BE USED FOR A GAME

(75) Inventors: Christopher Bryan McAndrew, Los Angeles, CA (US); Justin Gary, Oceanside, CA (US); James Keifer, Idyllwild, CA (US)

(73) Assignee: Spin Master Ltd., Toronto (CA)

( * ) Notice: Subject to any disclaimer, the term of this patent is extended or adjusted under 35 U.S.C. 154(b) by 36 days.

(21) Appl. No.: 13/173,011

(22) Filed: Jun. 30, 2011

(65) Prior Publication Data

US 2012/0001390 A1 Jan. 5, 2012

Related U.S. Application Data

(60) Provisional application No. 61/361,359, filed on Jul. 2, 2010, provisional application No. 61/473,510, filed on Apr. 8, 2011.

(51) Int. Cl.
*A63F 3/00* (2006.01)

(52) U.S. Cl.
USPC ..... 273/288

(58) Field of Classification Search
USPC ..... 273/288, 292
See application file for complete search history.

(56) References Cited

U.S. PATENT DOCUMENTS

| | | | | |
|---|---|---|---|---|
| 2,019,732 | A * | 11/1935 | Roland | 273/293 |
| 2,592,122 | A | 4/1952 | de Jesus | |
| 3,731,936 | A | 5/1973 | Copeland | |
| 6,254,099 | B1 | 7/2001 | Pederson | |
| RE37,957 | E | 1/2003 | Garfield | |
| 6,623,010 | B1 | 9/2003 | Holland, Jr. | |
| 7,144,013 | B2 | 12/2006 | Tanaka | |

(Continued)

FOREIGN PATENT DOCUMENTS

| | | | |
|---|---|---|---|
| DE | 20115091 | U1 | 11/2001 |
| EP | 1977800 | A1 | 10/2008 |

(Continued)

OTHER PUBLICATIONS

European Patent Office, Partial European Search Report dated Sep. 30, 2011 (3 pgs).

(Continued)

*Primary Examiner* — Michael Dennis
(74) *Attorney, Agent, or Firm* — Harris Beach PLLC

(57) ABSTRACT

In an aspect, the invention is directed to a set of game pieces including a character game piece representing a character and a plurality of parameter impact game pieces. Each of the parameter impact game pieces includes a parameter impact indicator. When a parameter impact game piece is stacked on the character game piece the parameter impact indicator provides a graphic representation of the parameter impact carried out by the parameter impact game piece. When another parameter impact game piece is stacked on the first parameter impact game piece a graphic representation of the total parameter impact carried out by both parameter impact game pieces is provided by permitting the parameter impact indicators from both parameter impact game pieces to be visible to the players. In this way, the parameter impact level incurred by the character can be shown to increase incrementally after subsequent parameter impacts.

13 Claims, 16 Drawing Sheets

U.S. PATENT DOCUMENTS

| | | | |
|---|---|---|---|
| 7,435,171 | B2 | 10/2008 | Hanafusa |
| 7,520,508 | B2 | 4/2009 | Redd |
| 2002/0147039 | A1 | 10/2002 | Mahar et al. |
| 2004/0157195 | A1 | 8/2004 | Andresen |
| 2006/0202423 | A1 | 9/2006 | Tanaka |
| 2009/0023487 | A1 | 1/2009 | Gilson et al. |

FOREIGN PATENT DOCUMENTS

| | | | |
|---|---|---|---|
| EP | 2044983 | A1 | 4/2009 |
| GB | 2433037 | A | 6/2007 |
| KR | 100883966 | B1 | 2/2009 |
| WO | WO-2006081176 | A2 | 8/2006 |

OTHER PUBLICATIONS

European Patent Office Search Report for corresponding EP Application No. 11172194.0, dated Jan. 9, 2012 (9 pgs).

Canadian Intellectual Property Office, International Search Report and Written Opinion, dated Oct. 17, 2011 (9 pgs).

http://boardgamegeek.com/boardgame/12692/gloom; Gloom 2004 (3 pgs).

http://www.atlas-games.com/product_tables/AG1250.php; Gloom: The Game of Inauspicious Incidents and Grave Consequences (2 pgs).

* cited by examiner

GAME, METHOD OF PLAY, AND STACKABLE MEMBERS SUCH AS CARDS WHICH MAY BE USED FOR A GAME

CROSS REFERENCE TO RELATED APPLICATIONS

This application claims priority to U.S. Provisional Patent Application No. 61/361,359, filed Jul. 2, 2010 and to U.S. Provisional Patent Application No. 61/473,510, filed Apr. 8, 2011, both of which are incorporated herein by reference.

FIELD OF THE INVENTION

The present invention relates to cards or other stackable members, games that involve the use of stackable game pieces, such as cards, and more particularly to battle games that involve the use of cards to represent actions, such as attacks.

BACKGROUND OF THE INVENTION

Currently available collectible card games (referred to sometimes as CCG's) typically involve one or more characters that attack each other using cards, dice and/or other objects to symbolically carry out the attacks. These current games represent a genre that can be enjoyable, but is hampered by several problems.

One problem is that these games are sometimes relatively complex and involve many different cards which are in play simultaneously and which must all be tracked by the players. These games typically require a relatively long time to learn before they can be played, thereby detracting from their appeal.

Another problem is that these games typically require the use of paper and pencil to keep track of certain parameters, such as a character's health level, or strength. This added task of writing down current values for such parameters can detract from the enjoyment of the game and the game flow.

Another problem with such games is that they can lack visual appeal as compared to a video game, notwithstanding the use of relatively strong colours on the cards.

It would be beneficial to provide a card-based game or the like, that mitigates some or all of the above problems at least to some degree.

SUMMARY OF THE INVENTION

In a first aspect, the invention is directed to a set of game pieces including a character game piece representing a character and a plurality of parameter impact game pieces. Each of the parameter impact game pieces includes a parameter impact indicator. When a parameter impact game piece is stacked on the character game piece the parameter impact indicator provides a graphic representation of the parameter impact carried out by the parameter impact game piece. When another parameter impact game piece is stacked on the first parameter impact game piece a graphic representation of the total parameter impact carried out by both parameter impact game pieces is provided by permitting the parameter impact indicators from both parameter impact game pieces to be visible to the players. In this way, the parameter impact level incurred by the character can be shown to increase incrementally after subsequent parameter impacts.

In some embodiments, the graphic representation somewhat mimics the appearance of a power bar or the like that represents a character's health or energy in a video game.

In a particular embodiment of the first aspect, the invention is directed to a set of game pieces including a character game piece, a first parameter impact game piece, and a second parameter impact game piece. The character game piece is for use by a first player and includes a representation of a character. The character game piece includes a parameter representation area that includes a graphical representation of a parameter for the character. The first parameter impact game piece is for use by a second player and has a parameter impact indication area that includes a first parameter impact indicator and a first generally transparent portion. The second parameter impact game piece is for use by the second player and has a parameter impact indication area that includes a second parameter impact indicator and a second generally transparent portion. When the parameter impact indication areas of the first and second parameter impact game pieces are stacked on top of the parameter representation area of the character game piece the first and second parameter impact indicators overlie at least a portion of the parameter representation area of the character game piece thereby indicating a parameter impact level to the parameter that is greater than would be indicated by placing the parameter impact indication area of only one of the first or second parameter impact game pieces alone on top of the parameter representation area of the character game piece.

In some embodiments, the parameter impact game pieces are attack game pieces and the parameter impact indicator indicates a level of damage to the character.

In a second aspect, the invention is directed to a set of game pieces including a plurality of character game pieces and a plurality of parameter impact game pieces. Each character game piece includes a character representation area which includes a graphical representation of a character. Each parameter impact game piece includes an parameter impact representation area which includes a graphical representation of a type of parameter impact and a generally transparent portion such that superposition of the parameter impact representation area of one of the parameter impact game pieces on the character representation area of one of the character game pieces shows the graphical representation of the character under the graphical representation of the type of parameter impact thereby illustrating graphically the parameter impact being carried out on the character.

In some embodiments of the second aspect, the graphical representation of the parameter impact is representative of a type of attack.

In some embodiments of the second aspect, the graphical representation of the parameter impact changes in appearance based on the angle of viewing by a player. In particular, the graphical representation of the parameter impact may change to reveal an animation related to the parameter impact, based on the angle of viewing by a player. This animation effect may be achieved through the use of a lenticular lens on the surface of the parameter impact game pieces.

In some embodiments of the second aspect, the superposition of a plurality of the attack game pieces on one of the character game pieces shows the graphical representation of the character under the graphical representations of the types of attacks and shows each of the graphical representations of the types of attacks, thereby revealing a chronology of attacks carried out on said one of the character game pieces.

In some embodiments of the second aspect, each character game piece includes first indicia representing a first value of a parameter associated with the character and the set of game pieces further comprises a plurality of character modification game pieces, wherein each character modification game piece includes second indicia relating to the parameter, wherein superposition of one of the character modification game pieces on one of the character game pieces establishes a second value for the parameter.

In a third aspect, the invention is directed to a method of game play by a first player and a second player, comprising:

Providing a character game piece to one of the first and second players, wherein the character game piece includes a representation of a character, and a parameter representation area that includes a graphical representation of a parameter for the character;

Providing a first attack game piece for use by the other of the first and second players, wherein the first attack game piece has a damage indication area that includes a first damage indicator and a first generally transparent portion;

Stacking the damage indication area of the first attack game piece by the other of the first and second players on top of the parameter representation area of the character game piece so that the first damage indicator overlies a first portion of the parameter representation area thereby indicating a first level of damage to the parameter;

Providing a second attack game piece for use by the other of the first and second players, wherein the second attack game piece has a damage indication area that includes a second damage indicator and a second generally transparent portion; and Stacking the damage indication area of the second attack game piece on top of the damage indication area of the first attack game piece so that the second damage indicator overlies a second portion of the parameter representation area thereby indicating a second level of damage to the parameter, which is greater than the first lever of damage.

In a fourth aspect, the invention is directed to a set of stackable members, including a first stackable member and a second stackable member. Each stackable member has a graphical representation and a lenticular lens thereon, which changes the appearance of the graphical representation based on the angle of viewing by a user, thereby providing an appearance change for the user. Each lenticular lens is made up of lenticules. The lenticules on the second stackable member extend at least a selected angle relative to the lenticules on the first stackable member. The selected angle is selected so that when the second stackable member is stacked on the first stackable member, the appearance changes provided by the lenticular lenses on the first and second stackable members are visible to the user. By contrast, if the lenticules on the first stackable member and on the second stackable member were generally parallel, the appearance change on the lower of the two stackable members may be obscured.

In a particular embodiment of the fourth aspect, the first stackable member includes a first representation area which includes a first graphical representation. The second stackable member includes a second representation area which includes a second graphical representation. Each stackable member includes a lenticular lens superimposed on the graphical representation. The lenticular lens changes the appearance of the graphical representation based on the angle of viewing by a user. The lenticular lens of the first stackable member has first lenticules extending in a first direction, and the lenticular lens of the second stackable member has second lenticules extending in a second direction that is at least a selected angle relative to the first direction.

In some embodiments of the fourth aspect, the set of stackable members further includes a base stackable member that includes a base element representation area which includes a graphical representation of a base element.

In a fifth aspect, the invention is directed to a set of stackable members, including a first stackable member and a plurality of second stackable members. Each second stackable member includes a graphical representation of an effect relating to something on the first stackable member, and a lenticular lens on the graphical representation to change the appearance of the graphical representation based on the angle of viewing by a user. Each second stackable member further includes a lensless transparent portion positioned to permit viewing of a portion of the information on the first stackable member underneath when the second stackable member is stacked on the first stackable member.

In a particular embodiment of the fifth aspect, the first stackable member that includes information relating to a base element, and each second stackable member is an effect stackable member that includes an effect representation area which includes a graphical representation of an effect and a lenticular lens superimposed on the graphical representation of the effect. The lenticular lens changes the appearance of the graphical representation of the effect based on the angle of viewing by a user. Each effect stackable member further includes a lensless transparent portion positioned to permit viewing of a portion of the information relating to the base element on the base stackable member when the effect stackable member is stacked on the base stackable member.

In a sixth aspect, the invention is directed to a set of stackable members, including a base stackable member, a first effect stackable member and a second effect stackable member. The base stackable member includes a base element representation area which includes a graphical representation of a base element. The first effect stackable member includes a first effect representation area which includes a graphical representation of a first effect and a first generally transparent portion positioned such that superposition of the first effect representation area on the base element representation area of the base stackable member shows the graphical representation of the base element under the graphical representation of the first effect thereby illustrating graphically the first effect being carried out on the base element. The second effect stackable member includes a second effect representation area which includes a graphical representation of a second effect and a second generally transparent portion positioned such that superposition of the second effect representation area on the first effect representation area of the first effect stackable member shows the graphical representation of the first effect under the graphical representation of the second effect thereby illustrating graphically the first effect and the second effect being carried out. Each effect stackable member includes a lenticular lens superimposed on the graphical representation of the effect wherein the lenticular lens changes the appearance of the graphical representation of the effect based on the angle of viewing by a user. The lenticular lens of the first effect stackable member has first lenticules extending in a first direction, and the lenticular lens of the second effect stackable member has second lenticules extending in the first direction. The second generally transparent portion is lensless.

In a seventh aspect, the invention is directed to a set of stackable members including a base stackable member and an effect stackable member. The base stackable member includes a graphical representation thereon. The effect stackable member includes a graphical representation of an effect and a generally transparent portion such that superposition of the effect stackable member on the base stackable member shows the graphical representation from the base stackable member under the graphical representation of the type of parameter impact thereby illustrating graphically the parameter impact being carried out on the character. The effect stackable member further includes a lenticular lens superimposed on the graphical representation of the effect. The lenticular lens changes the appearance of the graphical representation of the effect based on the angle of viewing by a user.

In an eighth aspect, the invention is directed to a set of game pieces including first and second character game pieces, and first and second parameter impact game pieces. The first and second character game pieces are arrangeable adjacent one another. Each character game piece includes a character representation area which includes a graphical representation of a character. Each parameter impact game piece includes a parameter impact representation area which includes a graphical representation of a type of parameter impact and a generally transparent portion such that superposition of the parameter impact representation area of one of the parameter impact game pieces on the character representation area of one of the character game pieces shows the graphical representation of the character under the graphical representation of the type of parameter impact thereby illustrating graphically the parameter impact being carried out on the character. The graphical representations on the first and second parameter impact game pieces together form a composite image when the first and second parameter impact game pieces are arranged adjacent one another. The first and second parameter impact game pieces are stackable on the first and second character game pieces adjacent each other to form the composite image.

BRIEF DESCRIPTION OF THE DRAWINGS

The present invention will now be described by way of example only with reference to the attached drawings, in which.

DETAILED DESCRIPTION OF THE INVENTION

Figure 1:
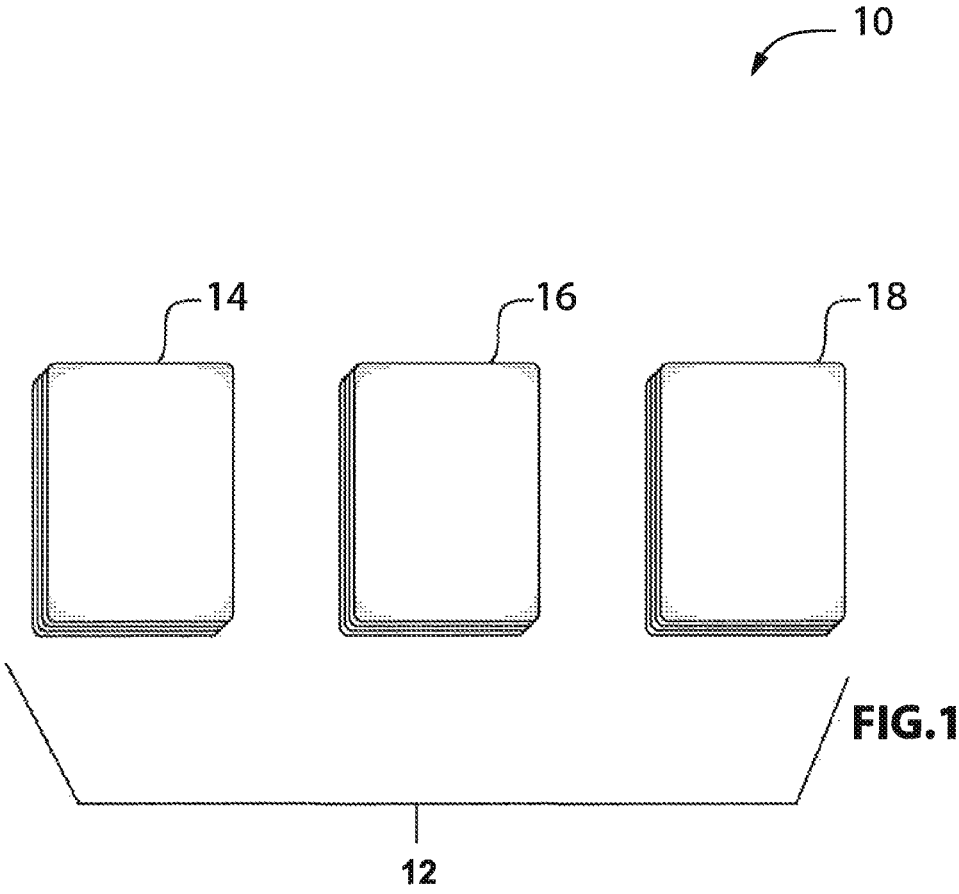
FIG. 1 is a plan view of a set of game pieces for use in a game in accordance with an embodiment of the present invention.

Reference is made to FIG. 1, which shows a set 10 of game pieces 12 for use in playing a game, in accordance with an embodiment of the present invention. The game pieces may be any suitable game pieces, such as, for example, collectible cards, and may be made from any suitable material, such as a polymeric material. The game pieces include a plurality of character game pieces 14, a plurality of attack game pieces 16 and a plurality of character modification game pieces 18.

Figure 2:
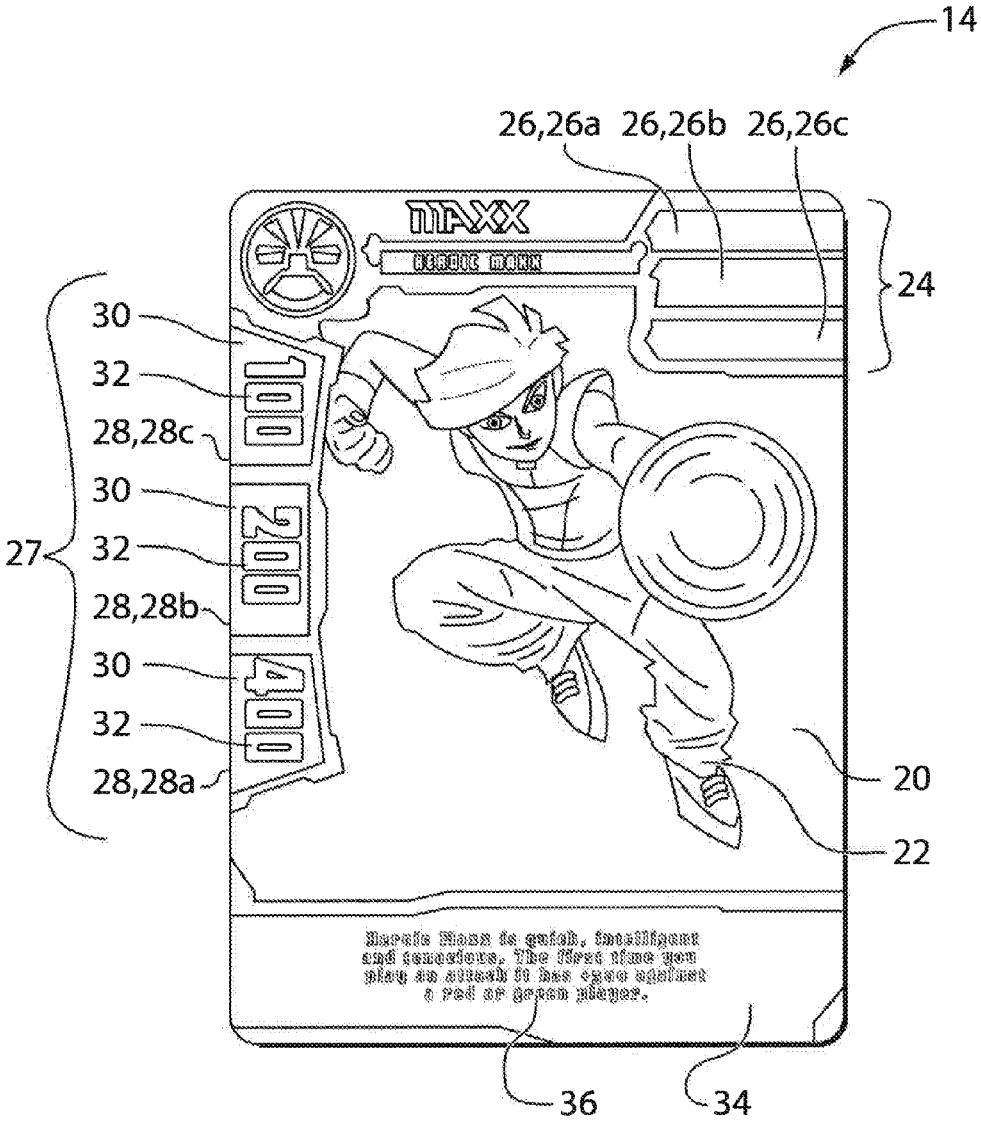
FIG. 2 is a plan view of a character game piece shown in FIG. 1.

An example of a character game piece 14 is shown in FIG. 2. Each character game piece 14 has a character representation area 20 which includes a graphic representation 22 of a character. The graphic representation 22 of the character may be in any suitable form. For example, the graphic representation 22 of the character may be enhanced with a three-dimensional effect or with an animation through the use of a lenticular lens on the upper surface of the character game piece 14. The lenticular lens is shown at 100 in FIG. 10 and is superimposed on the graphical representation 22. The lenticular lens 100 is formed by a plurality of lenticules shown at 102. Depending on the orientation of the lenticules 102 a particular type of effect can be achieved. For example, if the lenticules are oriented up and down along the card (i.e. in a direction that extends between a lower edge portion 103*a* and an upper edge portion 103*b*), a three-dimensional effect may be provided to the image shown in the graphical representation 22, since the eyes of the user would see the lenticules 102 from different angles.

The character game piece 14 further includes a parameter representation area shown at 24 which illustrates the state of a selected parameter related to the character. For example, the parameter representation area 24 may represent the health of the character, the energy level of the character or any other suitable parameter. The parameter representation area 24 on the character game piece 14 shown in FIG. 2 includes 3 sub-areas 26 (shown individually at 26*a*, 26*b* and 26*c*), although it is alternatively possible in other embodiments for it to include any other suitable number of sub-areas 26, such as 2 portions, or 4 or more portions. In the embodiment shown in FIG. 2, the sub-areas 26 are shaped as bars, however it is alternatively possible for the sub-areas 26 to have any other suitable shape. The parameter representation area 24 provides a graphic illustration of the state of the selected parameter of the character. An increase in the value of the parameter (eg. an increase in the health of the character) is indicated by an increased number of sub-areas 26 that appear to be a first colour. For the character game piece 14 shown in FIG. 2, parameter being represented is health, and the character is in full health, since all of the sub-areas 26 of the health representation area are the first colour.

The character game piece 14 may further include one or more textual information areas containing textual information. One such textual information area shown in FIG. 2 is a defense indication area 27 comprising one or more defense strength indication zones 28. In the embodiment shown in FIG. 2, 3 defense strength indication zones are shown, at 28*a*,

28*b* and 28*c* respectively. Each defense strength indication zone 28 includes a colour 30 and defense strength indicia 32 which make up textual information in the defense indication area 27, and which indicate the strength of the defense that the character when being attacked. In the exemplary character game piece 14 shown in FIG. 2, the character has a defense value of 400 for attacks of a first colour, a defense value of 200 for attacks of a second colour, and a defense value of 100 for attacks of a third colour. Attacks can be made on the character in any of the first second or third colours, which will be explained further below.

The character game piece 14 may further include a textual information area shown at 34 is a rule description area which includes textual information 36 in the form of a rule. The textual information 36 may include a description of a particular power associated with the character. As an example, for the character game piece 14 shown in FIG. 2, the textual information includes a statement that "The first time you play an attack it has +300 against a red or green player".

Figure 11:
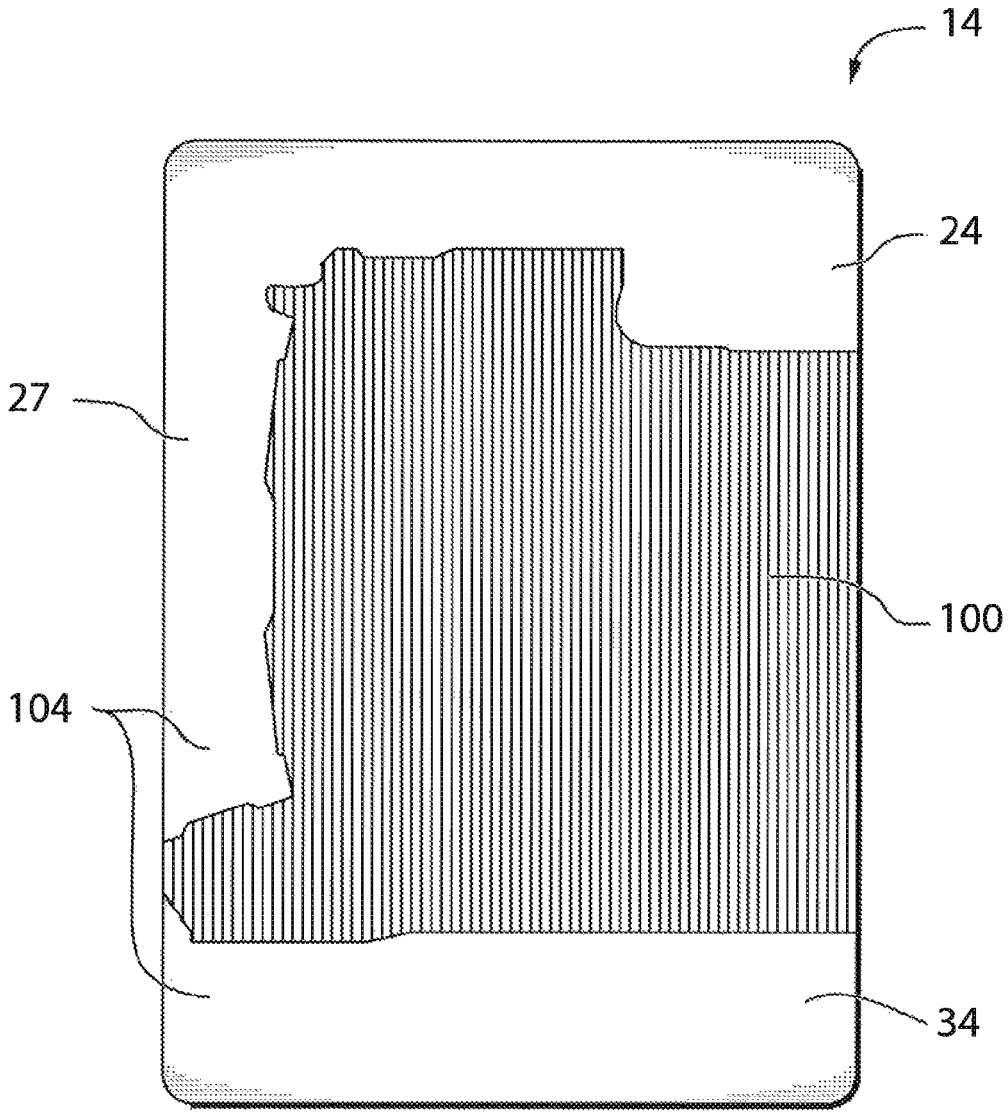
FIG. 11 is a plan view showing the lenticular lens on the game piece shown in FIG. 2.

Referring to FIG. 11, the lenticulated lens 100 on the game piece 14 may cover only a portion of the game piece 14. Thus a lensless portion shown at 104 may be provided. The lensless portion 104 may encompass the portions of the game piece 14 that include text, such as the textual information area 34, the defense indication area 27 and the parameter representation area 24, so as to render the text more legible.

Figure 3:
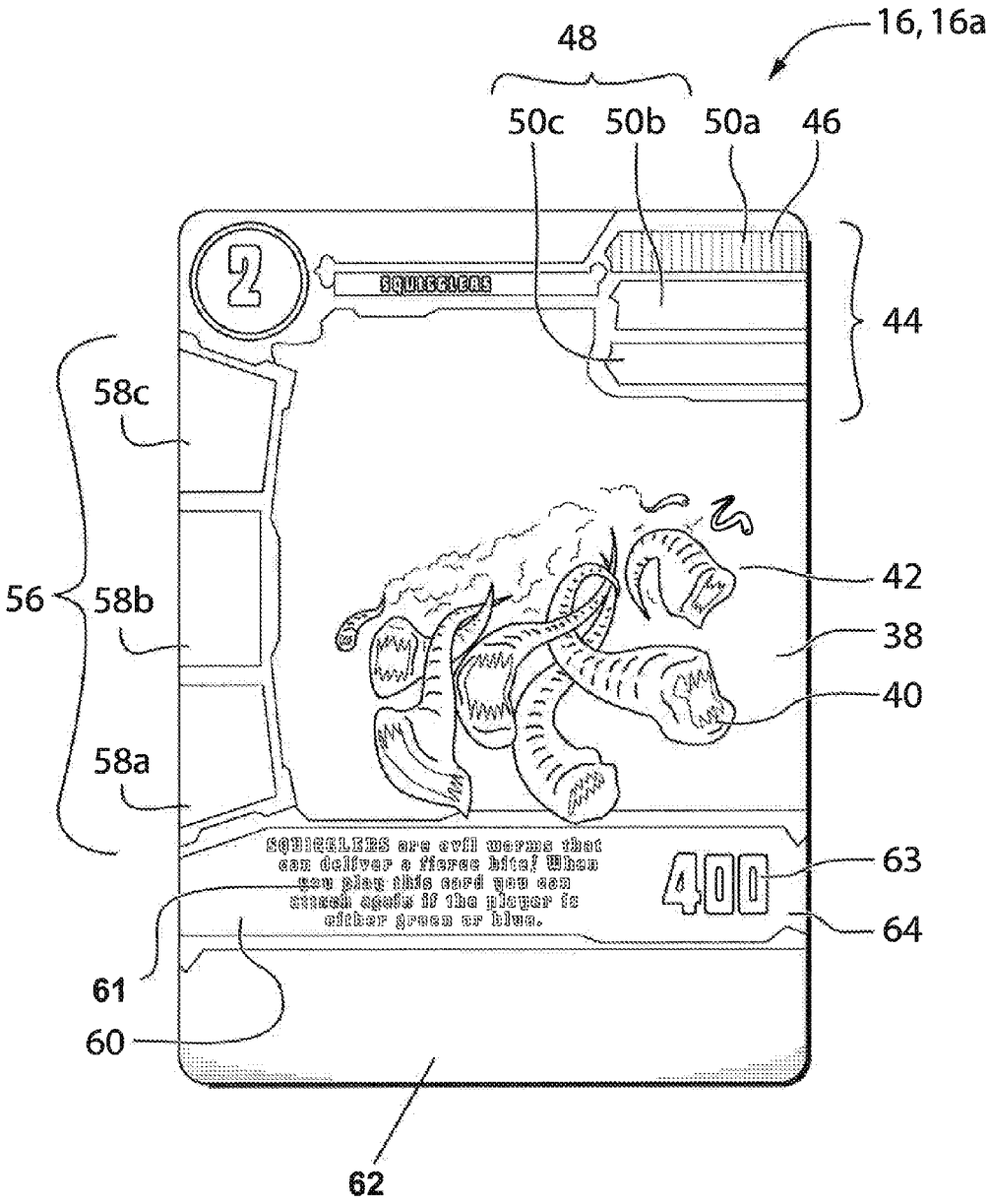
FIG. 3 is a plan view of an attack game piece shown in FIG. 1.

An example of an attack game piece 16 is shown in FIG. 3. The attack game piece 16 includes an attack representation area 38 which includes a graphic representation 40 of an attack, and which includes a transparent portion 42. For example, in the exemplary embodiment shown in FIG. 3, the graphic representation 40 shows several toothed worms which are referred to as 'squigglers'. The graphic representation 40 of the attack may be in any suitable form. For example, the graphic representation 40 of the attack may be enhanced with an animation effect through the use of a lenticular lens, shown at 106 in FIG. 10 and FIG. 12, on the upper surface of the attack game piece 16, or alternatively through some other technology. The animation effect may be useful to illustrate the type of attack that is carried out by playing the attack game piece 16. Thus, for the embodiment shown in FIG. 3, the animation effect may show the 'squigglers' opening and closing their jaws (to represent biting), as a player moves his/her head up and down along the lenticular lens.

Figure 10:
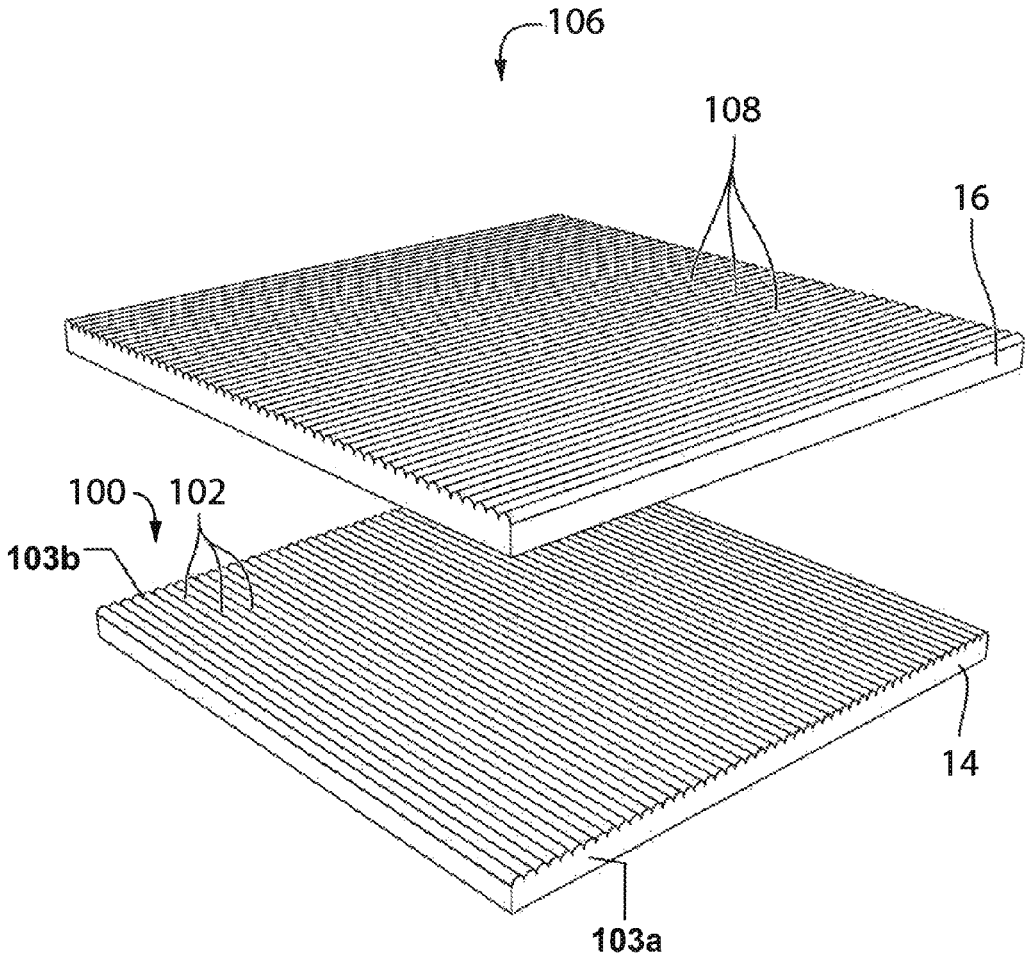
FIG. 10 is an exploded perspective view showing the orientations of lenticular lenses on the game pieces shown in FIGS. 2 and 3.

As shown in FIG. 10 the lenticular lens 106 is made up of lenticules 108. It will be noted that the lenticules 108 of the lens 106 are oriented along a direction line that is lateral, which facilitates the provision of the animation effect for the graphical representation 40 mentioned above. It will be noted that the lenticules 108 are generally perpendicular to the lenticules 102. As a result, the person viewing a stack comprising the attack game piece 16 on the character game piece 14, the appearance change (i.e. the visual effect) provided by lenticular lens 100 is not obscured. By contrast, if the direction lines of the lenticules 102 and 108 were generally parallel, then the graphic representation 22 shown on the bottom game piece 14 may be obscured because of a form of visual interference that is generated between the lenticules 102 and 108.

The obstruction of the graphic representation 22 generally decreases as the angle between the lenticules 102 and 108 increases. It has been found that an angle between the lenticules 102 and 108 of greater than about 40 degrees (i.e. between about 40 degrees and 90 degrees) will result in the graphic representation 22 being sufficiently visible to a user. In a preferred embodiment, however, the lenticules 102 and 108 are generally perpendicular to each other.

Thus, the lenticular lens 106 cooperates with the lenticular lens 100 to show a person viewing the stack a three-dimensional view of the character and an animation of the attack being carried out on the character.

Figure 4A:
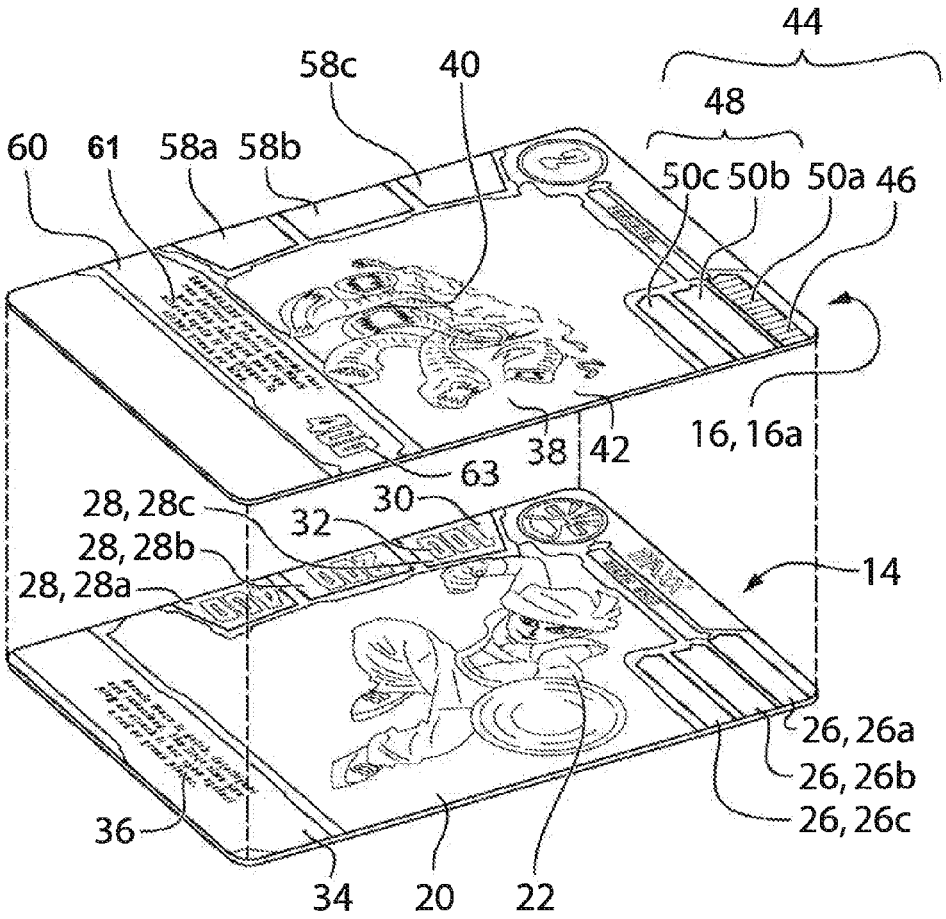
FIG. 4*a* is an exploded perspective view of the attack game piece shown in FIG. 3 on top of the character game piece shown in FIG. 2.
Figure 4B:
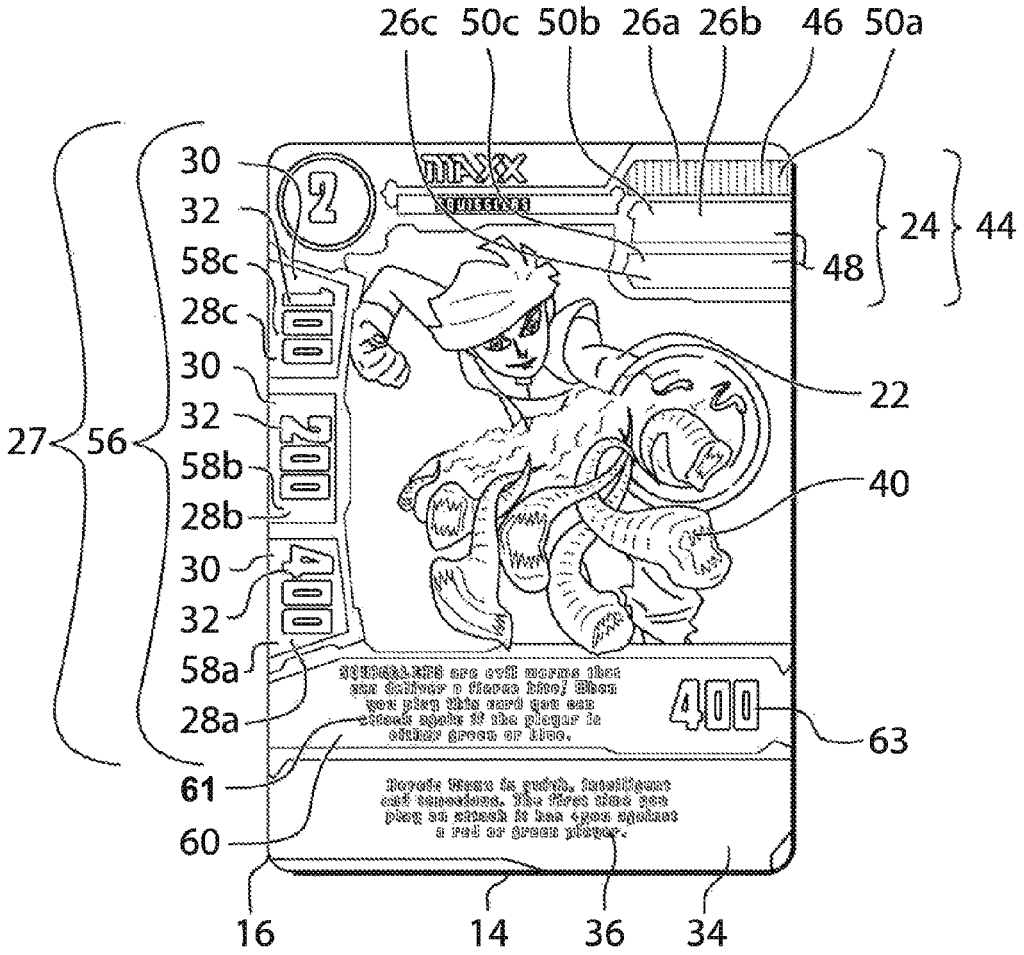
FIG. 4*b* is a plan view of the attack game piece shown in FIG. 3 on top of the character game piece shown in FIG. 2.

When the attack game piece 16 is placed on top of the character game piece 14, as shown in FIG. 4*a*, the attack representation area 38 overlies the character representation area 20 of the character game piece 14. Thus, the graphic representation 40 of the attack overlies the graphic representation 22 of the character, and portions of the graphic representation 22 of the character can be seen through the transparent portion 42 of the attack representation area 38 of the attack game piece 16. Thus the attack on the character is actually illustrated during game play, as shown in FIG. 4*b*. Furthermore, by providing the aforementioned animation effect, the actual action of the attack on the character is shown. In the exemplary embodiment shown in FIG. 4*b*, the 'squigglers' on game piece 16 appear to be biting the character shown on game piece 14.

The attack game piece 16 further includes a damage indication area shown at 44. The damage indication area 44 includes a damage indicator 46 and a transparent portion 48. The damage indicator 46 indicates the amount of damage that will be incurred to the value of the parameter represented in the parameter representation area 24 of the character game piece 14 on which the attack game piece 16 is played. The damage indicator 46 may be a bar that is a second colour that is different than the colour of the parameter representation area 24 shown on the character game piece 14. In the embodiment shown in FIG. 3, the damage indicator 46 occupies a first sub-area 50*a* of the damage indication area 44, and the transparent portion 48 is made up of second and third sub-areas 50*b* and 50*c* of the damage indication area 44. Another attack game piece 16 is shown in FIG. 5, which has a damage indication area 44 wherein the second sub-area 50*b* has the damage indicator 46, and wherein the first and third sub-areas 50*a* and 50*c* are transparent.

Figure 5:
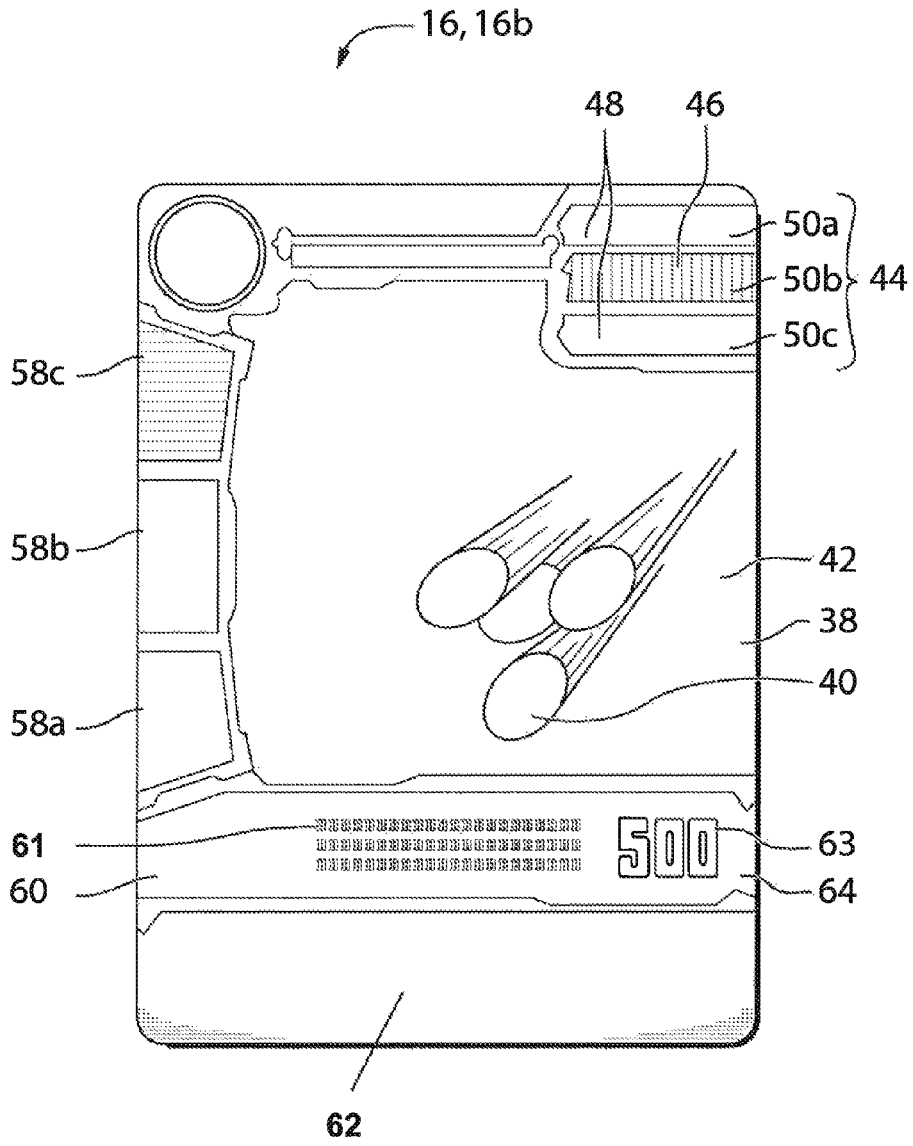
FIG. 5 is a plan view of another attack game piece shown in FIG. 1.

To distinguish between them, the attack game piece 16 shown in FIG. 3 may be referred to as attack game piece 16*a*, and the attack game piece shown in FIG. 5 may be referred to as attack game piece 16*b*.

When the attack game piece 16*a* is positioned on the character game piece 14 shown in FIG. 2 such that the attack representation area 38 overlies the character representation area 20, the damage indication area 44 also overlies the parameter representation area 24 of the character game piece 14 as shown in FIG. 4*b*. As can be seen, the damage indicator 46 covers the sub-areas 26*a* and the transparent portion 48 (ie. the transparent sub-areas 50*b* and 50*c*) covers the second and third sub-areas 26*b* and 26*c*. Thus, a player viewing the stacked game pieces 16 and 14 would see that the health of the character has two sub-areas of the first colour which are visible through the transparent portion 48 of the attack game piece 16, and one sub-area of the second colour which is the damage indicator 46 on the attack game piece 16. Thus, the health of the character that incurred the attack has declined by one, and is now only two bars.

Referring to FIG. 3, the attack game piece 16 further includes a defense modification area 56 which overlies the defense indication area 27. The defense modification area 56 is divided into three zones 58*a*, 58*b* and 58*c*. For the attack game piece 16*a* each of the zones 58*a*, 58*b* and 58*c* is transparent and so the defense strength indicia 32 are visible through the zones 58*a*, 58*b* and 58*c* when the attack game piece 16 is superimposed on the character game piece 14. For the attack game piece 16*b* shown in FIG. 5, the first zone 58*a* is opaque and thus covers the defense strength indicia 32 in the zone 28*c* on the character game piece 14. As a result, superimposing the attack game piece 16*b* on the character game piece 14 results in the loss of defense strength for attacks of a third colour.

Referring to FIG. 3, the attack game piece 16 further includes a textual information area 60 which may be related to a rule associated with the attack. The textual information area 60 includes textual information 61, which is the aforementioned rule. It will be noted that the textual information area 60 is positioned so as not to overlie the textual information area 34 on the character game piece 14. Optionally, the attack game piece 16 may have a textual information modification area 62 that does overlie the textual information area 34 on the character game piece 14. The textual information modification area 62 may be transparent so as to permit the textual information 36 on the character game piece 14 to remain readable and in force. On some attack game pieces 16, however, the textual information modification area 62 may be opaque so as to prevent the textual information 36 on the character game piece 14 from being read so that it is no longer applicable.

The attack game piece 16 may further include other textual information areas, such as, a textual information area that includes attack value indicia 63 (which is the textual information) and an attack colour 64. During game play, when an attack is carried out using the attack game piece 16 on the character game piece 14, the attack value represented by the indicia 63 is compared to the value indicated by the defense strength indicia 32 in the zone 28 having the same colour as the attack colour 64. For the game pieces 16 and 14 shown in FIGS. 3 and 2, the attack value 64 is 400 and is in the third colour and is thus compared to the defense strength value of 100 that is indicated in the third zone 28*c* which is of the third colour. If the attack value 64 is greater than the defense value 32, (which in this example, it is), the attack game piece 16 is placed on top of the character game piece 14 so that character game piece 14 incurs whatever damage is indicated by the damage indicator 46.

Figure 12:
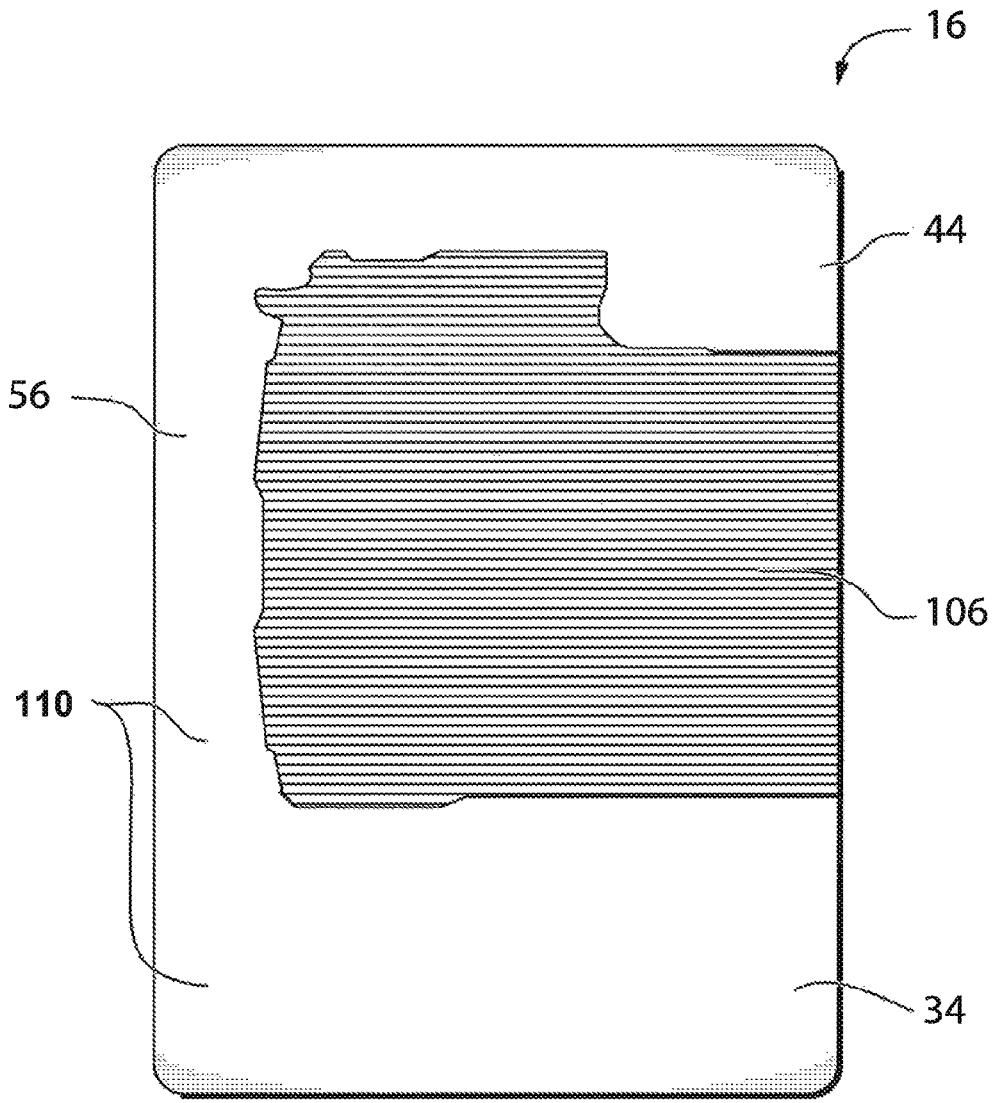
FIG. 12 is a plan view showing the lenticular lens on the game piece shown in FIG. 3.

Referring to FIG. 12, the attack game piece 16 further includes a lensless portion 110, which may be generally transparent and which may coincide with the portions of the character game piece 14 that contain text, such as the parameter representation area 24, the defense indication area 27 and the textual information area 34, to facilitate reading of the textual information on the character game piece 14. Furthermore, the lensless portion 110 may be positioned to encompass any portions of the attack game piece 16 that include textual information, such as, for example, the damage indication area 44, the defense modification area 56, the textual information area 60 and the indicia 63.

Figure 6:
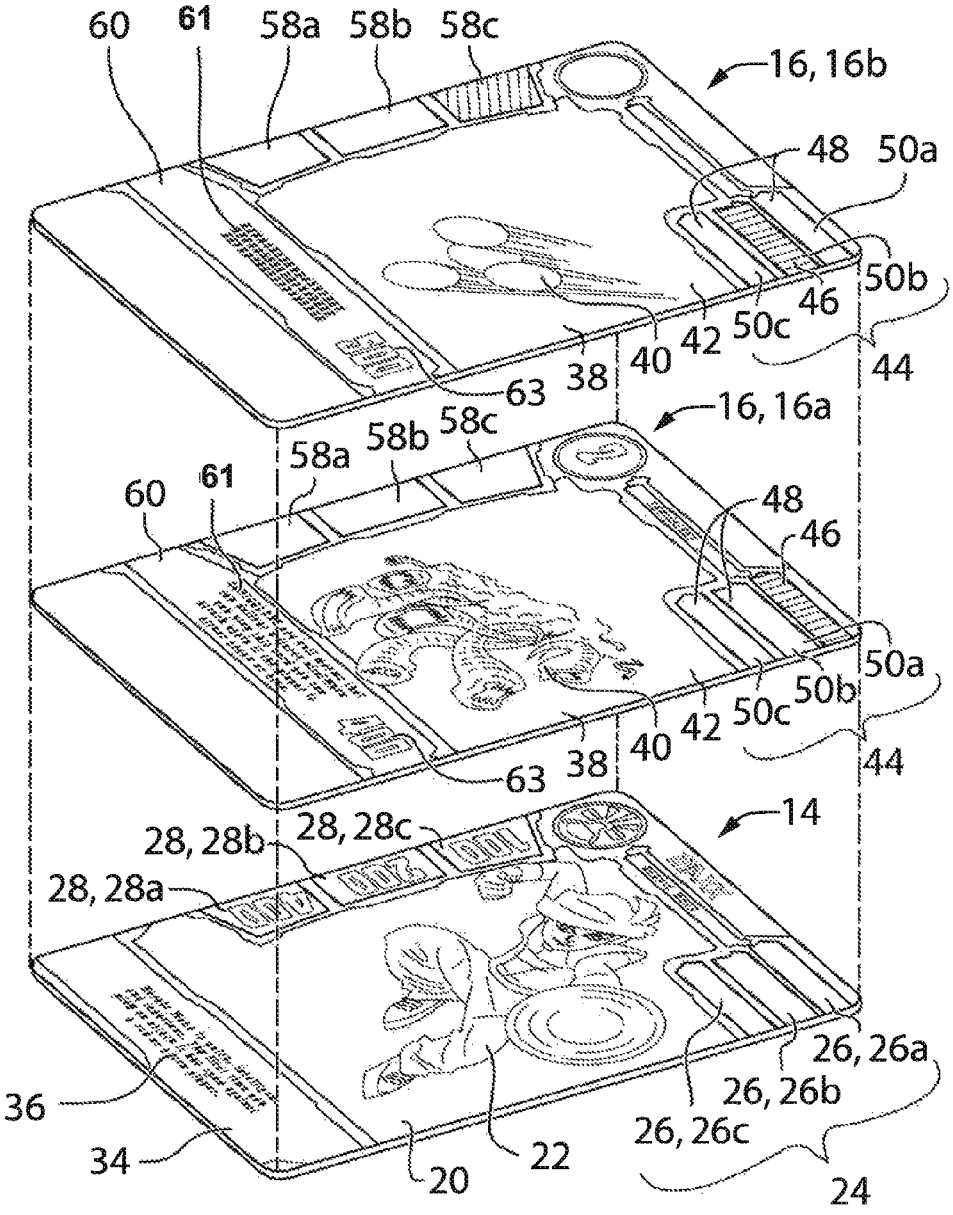
FIG. 6 is an exploded perspective view of the attack game piece shown in FIG. 5 on top of the attack game piece shown in FIG. 3 on top of the character game piece shown in FIG. 2.

During game play a plurality of attack game pieces 16 may be stacked on a character game piece 14. An example of this is shown in FIG. 6, which shows a situation that occurs when an attack is carried out on the character game piece 14 shown in FIG. 4*b*, which already has an attack game piece 16 thereon. In the example shown in FIG. 6, the attack game piece 16*a* will be referred to as a first attack game piece, and the attack game piece 16*b* will be referred to as a second attack game piece. It will be noted however, that it would be equally possible that during game play, the attack game piece 16*b* could have been played first and would thus be the first attack game piece and the attack game piece 16*a* could have been played afterwards and would thus constitute the second attack game piece. In the example shown in FIG. 6 the second attack game piece 16*b* is positioned such that its attack representation area 38 overlies the attack representation area 38 of the attack game piece 16*a* and overlies the character representation area 20 of the character game piece 14. As a result, the graphic representation 22 of the character is shown underneath the graphic representation 40 of the attack shown on the first attack game piece 16*a*, which is itself shown underneath the graphic representation 40 of the attack shown on the second attack game piece 16*b*. It will be noted that at a glance, all that the character has incurred in the form of attacks is visible immediately. In other words, the stacked game pieces 16 and 14 provide an instantly viewable chronology of attacks incurred by the character shown on the character game piece 14.

Additionally, superposition of the second attack game piece 16*b* on top of the first attack game piece 16*a* positions the attack indication area 44 on the second attack game piece 16*b* over the attack indication area 44 on the first attack game piece 16*a*. It will be noted that the damage indicator 46 on the second attack game piece 16*b* is visible to the players. Additionally, the damage indicator 46 from the first attack game piece 16*a* is visible through the transparent portion 48 on the second attack game piece 16*b*. Furthermore, one zone 26*c* of the character game piece 14 is visible through the transparent portions 50*b* and 50*c*. Accordingly, as shown in FIG. 6, the character has one bar of the parameter remaining (ie. the bar shown in zone 26*c*). It will be noted that the damage to the parameter of the character as shown in FIG. 6 is greater than the damage that would be incurred by placing either of the first or second game pieces 16*a* or 16*b* alone on the character game piece 14. In other words, the damage inflicted on the character by each of the attack game pieces 16*a* and 16*b* is additive. In some embodiments, (eg. where the parameter represented is a critical element of the character such as health or energy), when a sufficient number of attacks on the character are successful, the damage indicators 46 eventually fill up the entire parameter representation area 24 of the character game piece 14, which may mean that the character has in effect died and is out of play.

Figure 13:
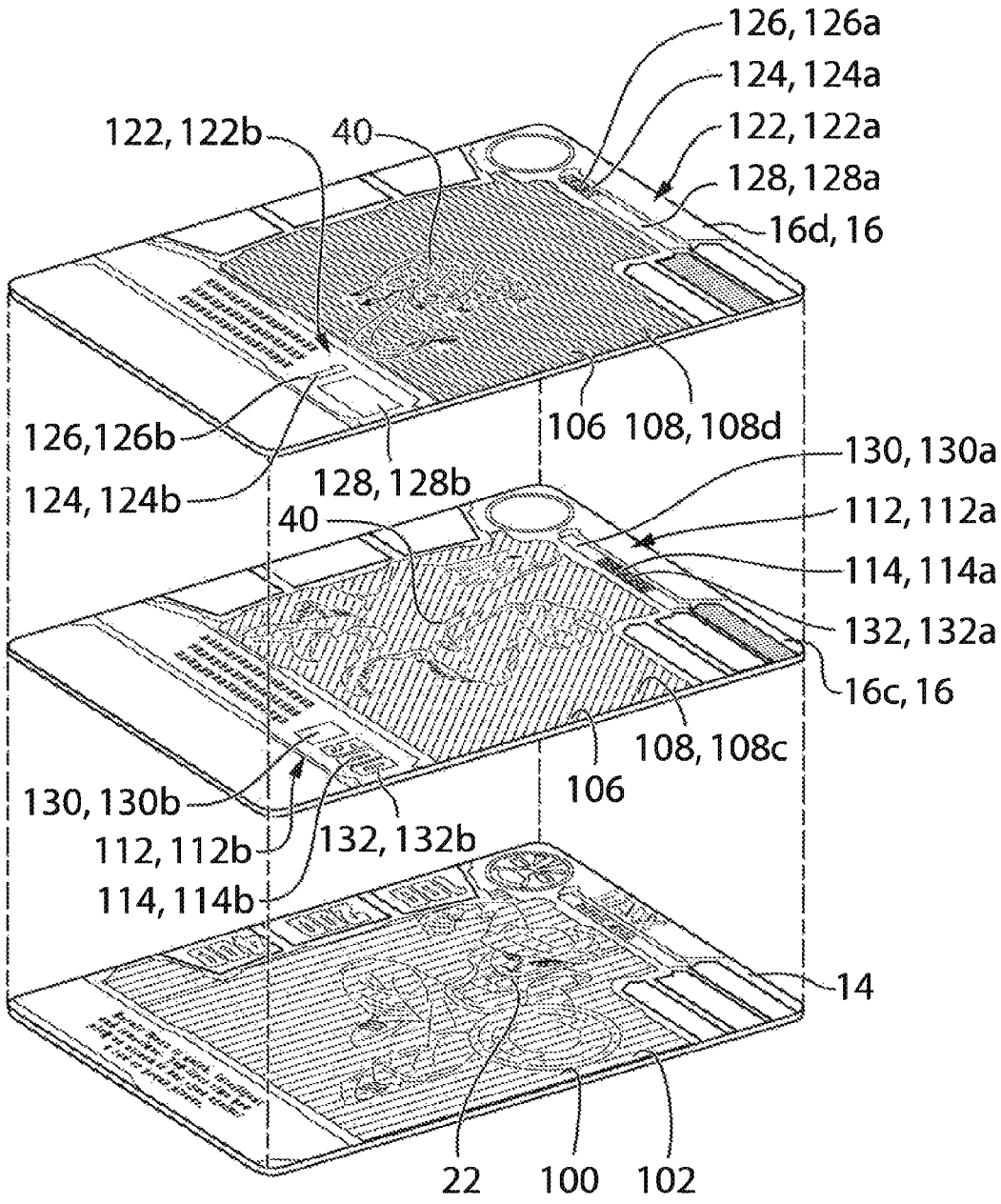
FIG. 13 is an exploded perspective view showing first and second attack game pieces that cooperate together to form a combination attack, on top of a character game piece.

Reference is made to FIG. 13, which shows an embodiment wherein a plurality of attack game pieces 16 cooperate with each other when laid down on each other. In FIG. 13, there is shown a character game piece 14, a first attack game piece 16*c* and a second attack game piece 16*d*. The lenticules on the game pieces 16*c* and 16*d* are identified at 108*c* and 108*d* respectively. The lenticules 102 and 108*c* on the game pieces 14 and 16*c* are formed so that there is an angle of between about 40 degrees and 45 degrees between them. The lenticules 108*d* on the game piece 16*d* are formed so that there is an angle of between about 80 and 90 degrees between them and the lenticules 102 on the game piece 14, and an angle of between about 40-45 degrees between them and the lenticules 108*c* on the game piece 16*c*. Other arrangements are also possible such that the three game pieces 102, 108*c* and 108*d* have angles of at least about 40 degrees and not more than 90 degrees relative to each of the other sets of lenticules.

As a result of the lenticules 102, 108*c* and 108*d* being arranged to meet this aforementioned criterion regarding their relative angles, the graphical representations 22 and 40 on the three game pieces 14, 16*c* and 16*d* can all be seen, without being significantly obscured by each other's lenticular lenses.

As shown in FIG. 13, the first attack game piece 16*c* has one or more first textual information areas 112 each containing first textual information 114. Examples include first textual information area 112*a* containing first textual information 114*a*, which is an attack type identifier, and another first textual information area 112*b* containing another first textual information 114*b*, which is the attack value indicia. The second attack game piece 16*d* includes one or more second textual information areas shown at 122, each of which includes an indiciated portion 124 containing second textual information 126 (i.e. containing indicia) and a transparent portion 128. Examples include second textual information area 122*a* including indiciated portion 124*a* containing second textual information 126*a* and transparent portion 128*a*, and another second textual information modification area 122*b* including indiciated portion 124*b* containing another second textual information 126*b* and transparent portion 128*b*. The textual information 126*a* in the example shown is an attack type identifier. When the game piece 16*d* is stacked on game piece 16*c*, the transparent portions 128*a* and 128*b* overlie the textual information 114*a* and 114*b* so that the textual information 114*a* and 114*b* is visible to the player through the transparent portions 128*a* and 128*b*. The indiciated portions 124*a* and 124*b* are positioned so that the textual information 126*a* cooperates with the textual information 114*a* to convey combined textual information to the user, and similarly the textual information 126*b* cooperates with the textual information 114*b* to convey combined textual information to the user. For example, the textual information 114*a* may be "NIGHTMARE", and the textual information 126*a* may be "GHOST", so that the combined textual information is GHOST NIGHTMARE. There may, for example, be different kinds of nightmare attack, one of which is referred to as a ghost nightmare, and there may be different kinds of ghost attack, one of which is a ghost nightmare attack.

The textual information 114*b* may indicate that the attack value is 500. The textual information 126*b* may be a '1' in the thousands position, so that when the game piece 16*d* is positioned on game piece 16*c*, the attack value is 1500.

It may alternatively or additionally be possible to configure the game piece 16*c* so that it can be stacked on top of the game piece 16*d* to convey combined textual information to the player. In such a case, the textual information areas 112*a* and 112*b* may further include transparent areas 130*a* and 130*b* adjacent indiciated areas 132*a* and 132*b* which contain the textual information 114*a* and 114*b* respectively.

Figure 14:
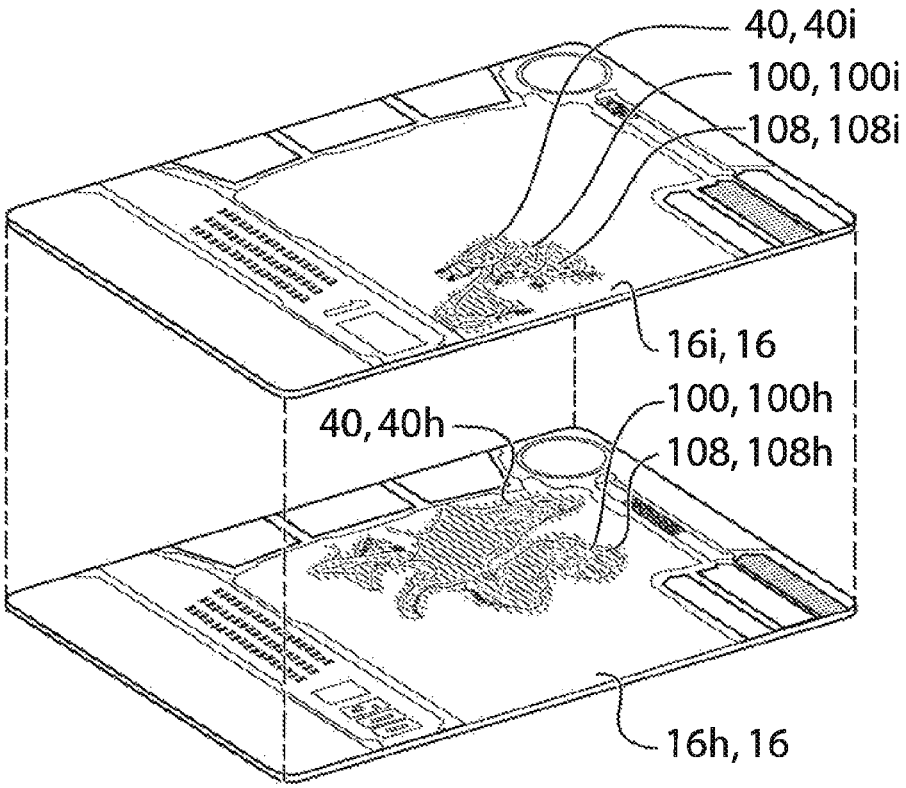
FIG. 14 is an exploded perspective view showing another first and second attack game pieces that cooperate together to form a combination attack.

Reference is made to FIG. 14, which a variant of the combination of attack game piece 16 shown in FIG. 13. The game pieces 16 in FIG. 14 are shown individually at 16*h* and 16*i*. The game pieces 16*h* and 16*i* may be similar to the game pieces 16*c* and 16*d*, except that the orientation of the lenticules 108*i* on the game piece 16*i* may be the same as that of the lenticules 108*h* on the game piece 16*h*. In such an embodiment, the graphic representations 40*h* and 40*i* are arranged so as to have not more than a selected amount of overlap (which may be no overlap in some embodiments) and the positions of the lenticular lenses 100*h* and 100*i* are selected so as to generate the desired visual effects for the player but to have not more than a selected amount of overlap (which may be no overlap in some embodiments), so as to avoid the problems associated with overlapping lenticular lenses oriented the same way, as described above. As a result of providing the lenticules 108*h* and 108*i* with the same orientation, the visual effects (e.g. the animation) associated with both lenses 100*h* and 100*i* are achieved simultaneously with movement in one direction to change in the angle of viewing of the stacked game pieces 16*h* and 16*i*. For example, with the game pieces 16*h* and 16*i* shown in FIG. 14, sweeping of the player's head towards the top edge or bottom edge of the game pieces 16*h* and 16*i* will generate an animation effect simultaneously with both game pieces 16*h* and 16*i*. By contrast, when the lenticules 108 are arranged in different orientations (e.g. perpendicular to each other), movement of the player's head in a single direction may show the animation effect on one game piece, but not as strongly (in some cases not at all) in the other.

Figure 7:
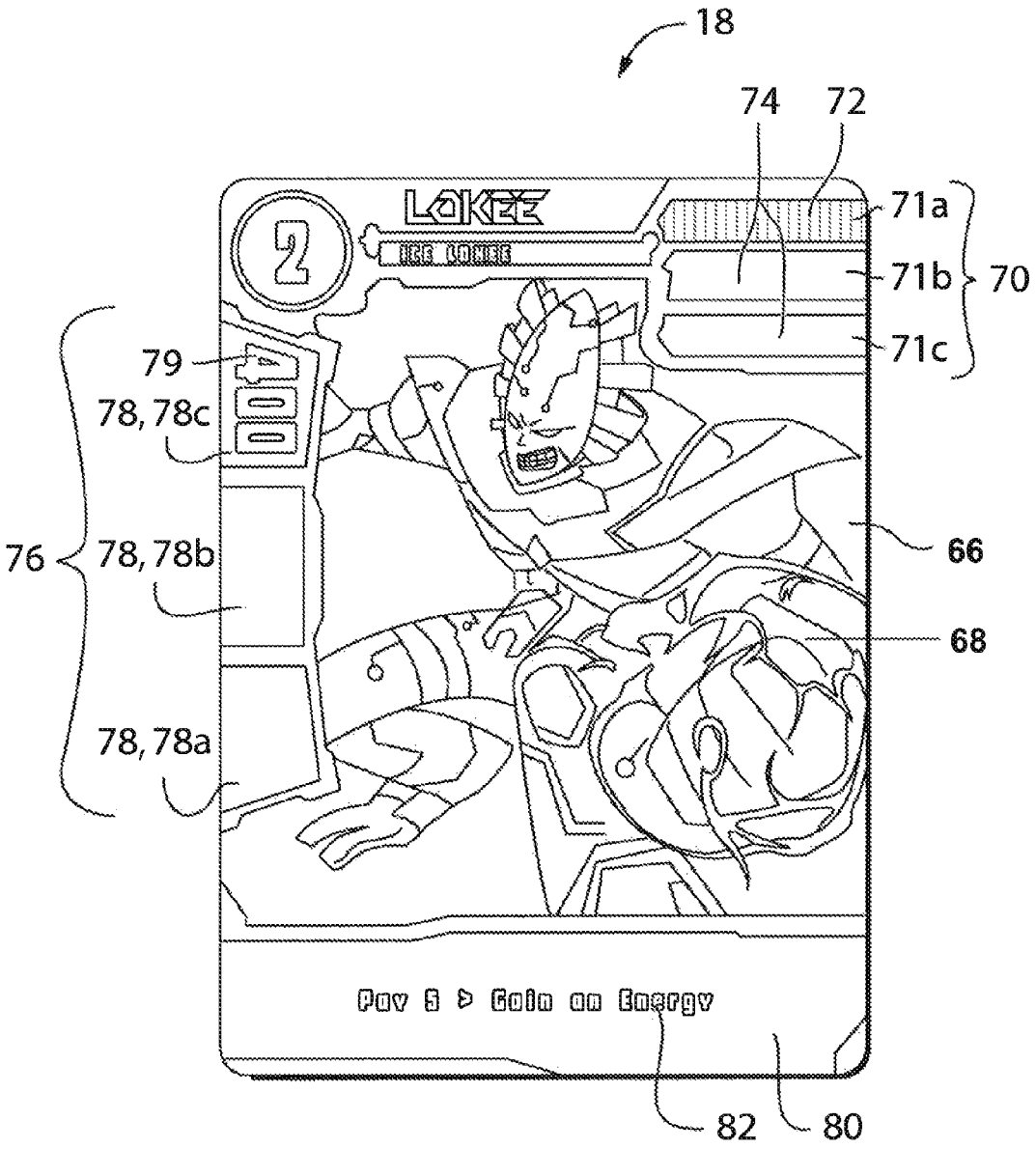
FIG. 7 is a plan view of a character modification game piece shown in FIG. 1.
Figure 8:
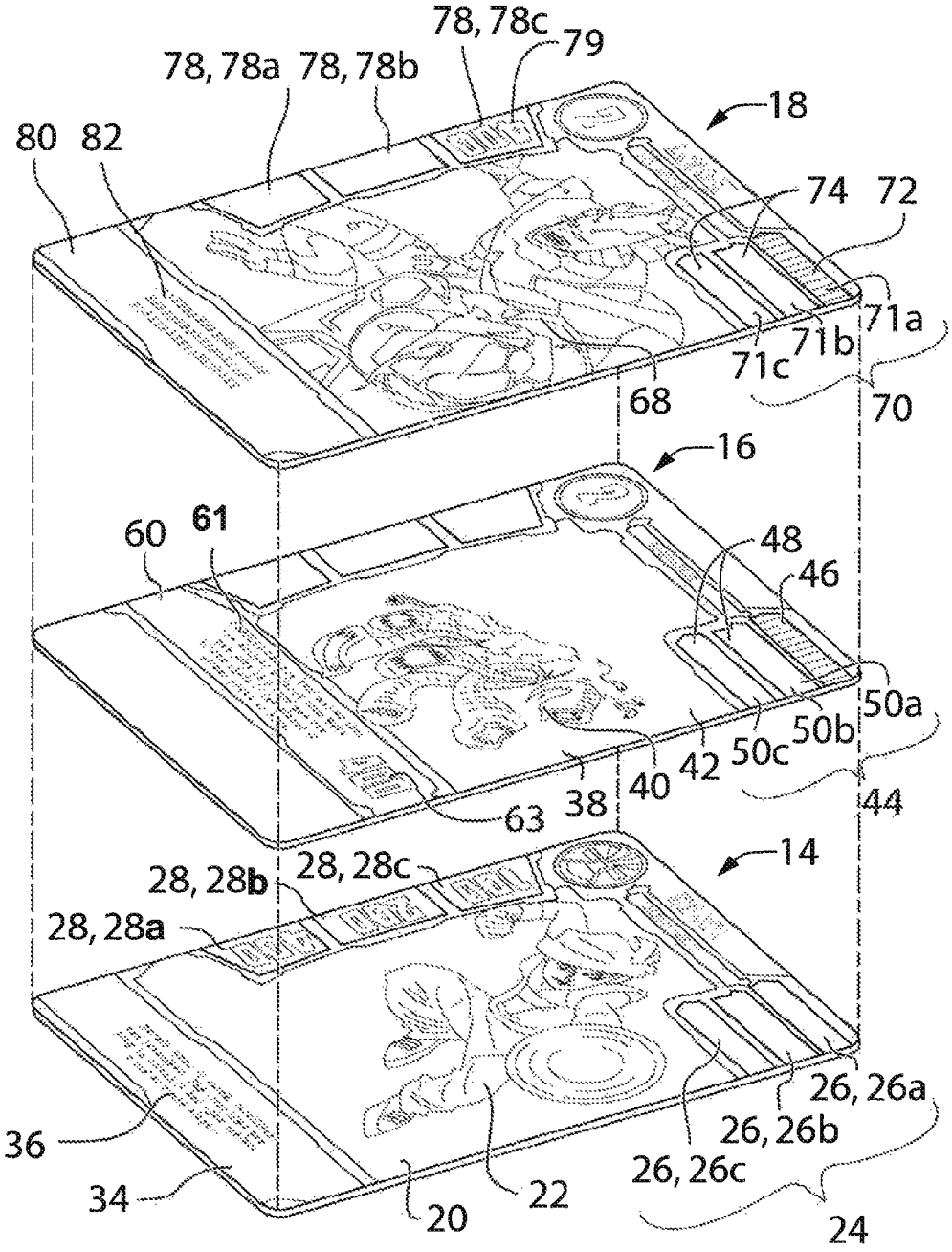
FIG. 8 is an exploded perspective view of the character modification game piece shown in FIG. 7 op top of the attack game piece shown in FIG. 5 on top of the attack game piece shown in FIG. 3 on top of the character game piece shown in FIG. 2.

The character modification game pieces 18 are game pieces that may be placed on top of a player's stack to alter the properties of the character represented on the character game piece underneath. An example of a character modification game piece 18 is shown in FIG. 7. The character modification game piece 18 includes a character representation area 66 which may be similar to the character representation area 20 of the character game piece 14 (FIG. 2), in that it shows a graphic representation 68 of a character. The character represented may be referred to as a monster in some embodiments and thus the character modification game piece 18 may be referred to as a monster game piece. The character modification game piece 18 further includes a parameter modification area 70 which may remove damage from the character in some instances. The parameter modification area 70 includes three sub-areas 71*a*, 71*b* and 71*c*, a parameter modifier 72 which may be any suitable colour that is different than the colour of the damage indicators 46 on the attack game pieces 16, and also includes a transparent portion 74. When the character modification game piece 18 is placed on top of a stack of game pieces 16 and 14 (eg. as shown in FIG. 8) the parameter modification portion 72 heals any damage that it overlies. In other words, if the parameter modification portion 72 overlies a damage indicator 46 on an attack game piece (as is the case in FIG. 8), the parameter modification portion 72 covers the damage indicator 46, thereby returning that bar to an undamaged or a healed state. Optionally, the parameter modifier 72 may be the same colour as the parameter representation area 24 on the character game piece 14. Alternatively it may be a different colour that is also different from the colour of a damage indicator 46. The transparent portion 74 shows any underlying damage indicators 46 or portions of the parameter representation area 24 and thus does not affect them.

The character modification game piece 18 further includes a defense strength modification area 76 that includes one or more defense modification zones 78 (shown individually at 78*a*, 78*b* and 78*c* in the example shown in FIG. 7). The defense modification zones 78 may include indicia indicating a modification to a particular defense strength value, or may be transparent. In the example shown in FIGS. 7 and 8, the defense strength values in the first and second zones 28*a* and 28*b* are unmodified as the first and second defense modification zones 78*a* and 78*b* are transparent. The defense strength value in the third zone 28*c* is covered by the indicia shown at 79 in the third defense modification zone 78*c*, and thus becomes (in the example shown) a value of 400 for attacks of the second colour instead of its original value of 100 for attacks of the third colour. Thus, the new defense values for the character are 400 for attacks of the first colour, 200+400 (ie. 600) for attacks of the second colour, and 0 for attacks of the third colour. The defense modification zones 78 therefore constitute textual information areas on the character modification game piece 18 in embodiments wherein they contain text (e.g. indicia 79).

The character modification game piece 18 further includes a textual information modification area 80, which overlies the textual information area 34 of the character game piece 14. The textual information modification area 80 contains different textual information shown at 82 (and is therefore a textual information area itself) which comes into play instead of the textual information on the character game piece 14.

Figure 9:
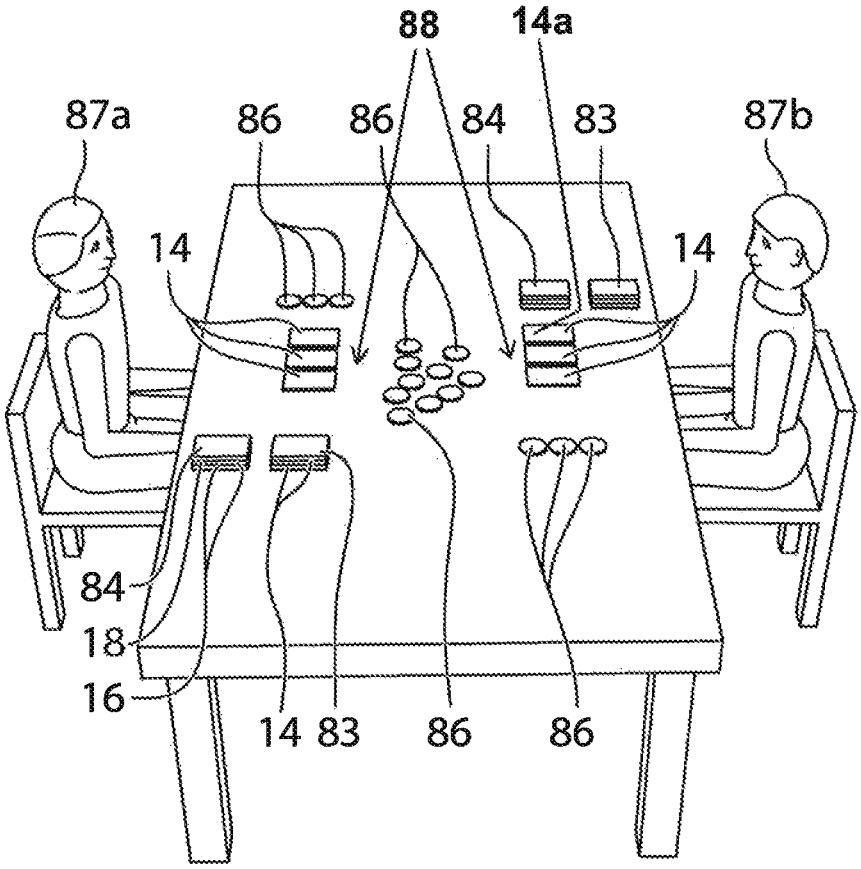
FIG. 9 is a perspective view illustrating the setup and game play for a game using the set of game pieces shown in FIG. 1.

An example of a method of game play using the set 10 of game pieces shown in FIG. 1 will now be explained. Referring to FIG. 9, the initial setup for the game includes a first step which is for each player to select three character game pieces 14 for use in the game from amongst those in his/her deck (shown at 83) of character game pieces 14. The selection of the three character game pieces 14 may be based on any desired criteria or strategy, such as their defense strength values and/or their textual information. Each player additionally draws three game pieces from his/her deck (shown at 84) of action game pieces, which contains a mix of attack game pieces 16 and character modification game pieces 18. Each player also starts with 3 energy tokens (shown at 86) which represent the amount of energy the player has. Energy is consumed when carrying out actions such as attacks on another player's characters.

The game play is as follows. A first player is shown at 87*a* and a second player is shown at 87*b*. At the beginning of a player's turn, the player carries out a preliminary step, wherein he/she receives an energy token 86, replenishes any consumed energy tokens 86 from their previous turn, and draws an action game piece from his/her deck 84 of action game pieces 16 and 14. The player then consumes energy (by expending energy tokens 86) to play a character modification game piece 18 if he/she has one, or to play an attack game piece 16 if he/she has one, or to use powers which are described in the textual information shown in whatever textual information area is visible to the player from the top of his three stacks shown at 88. In the first player's first turn, each stack 88 consists of a single game piece (ie. the character game piece 14), however as game play progresses, several game pieces 16 from the second player 87*b* and/or game pieces 18 from the first player 87*a* may be placed on one or more of the three character game pieces 14 that are in play for the first player 87*a*. As an example of an action carried out by the first player 87*a*, he/she may attempt an attack on one of the character game pieces 14 owned by the second player 87*b*. In this example, the first player 87*a* has selected the attack game piece 16*a* that shows 'squigglers', however any suitable attack game piece may be used. The first player 87*a* has in this example chosen to carry out the attack on the first character game piece (identified at 14*a*). In the exemplary attack, the attack colour is the third colour. To determine if the attack is successful, the attack value represented by the indicia 63 is compared to the defense strength value represented by the indicia 32 for attacks of the third colour on the character game piece 14*a*. If the attack value is higher than the defense value then the attack is successful and the attack game piece 16*a* is placed on the character game piece 14*a*, thereby giving the character one bar of damage as shown by damage indicator 46.

Assuming the first player 87*a* has enough energy tokens 86 to continue he/she may carry out further attacks on the second player's characters, or follow textual information, or play character modification cards on his own characters.

The textual information 36 contained on the character game piece 14 may relate to an ability associated with a character which, in the rules of some embodiments, is only available to use once per turn. In the rules of some embodiments, if an attack game piece 16 contains textual information 61 thereon, that textual information 61 is only applicable if the attack is successful. In some cases the textual information 61 identifies a secondary ability and a cost (in energy tokens 86) to carry out that secondary ability. If the player desires to carry out that secondary ability, it may at the expense of not carrying out the actual attack on the opposing player.

In some instances the textual information 36 on the character game piece 14 or on an attack game piece 16 includes the term 'React', which permits the player to play that ability during the other player's turn. When a player does so with an attack game piece 16, the attack game piece 16 is discarded afterwards and is thus not used in the usual way for carrying out an attack.

When the first player 87*a* has expended all the energy he/she can or wants to, it is the second player's turn to collect an energy token 86, replenish their expended energy tokens, draw an action game piece from his/her deck of game pieces 16, 18, and carry out any actions that are available to him/her.

It will be noted that it is possible that a player may carry out an attack on an opposing player's character using an attack game piece 16 that is the same as the player used in a prior attack on that character if the player has or acquires a second copy of that attack game piece 16. In such an instance, the damage indicator 46 on second copy of the attack game piece 16 will not increase the amount of damage inflicted on the character, since that bar of the parameter representation area 24 will already have been covered by the damage indicator 46 on the first copy of the attack game piece 16.

Figure 15:
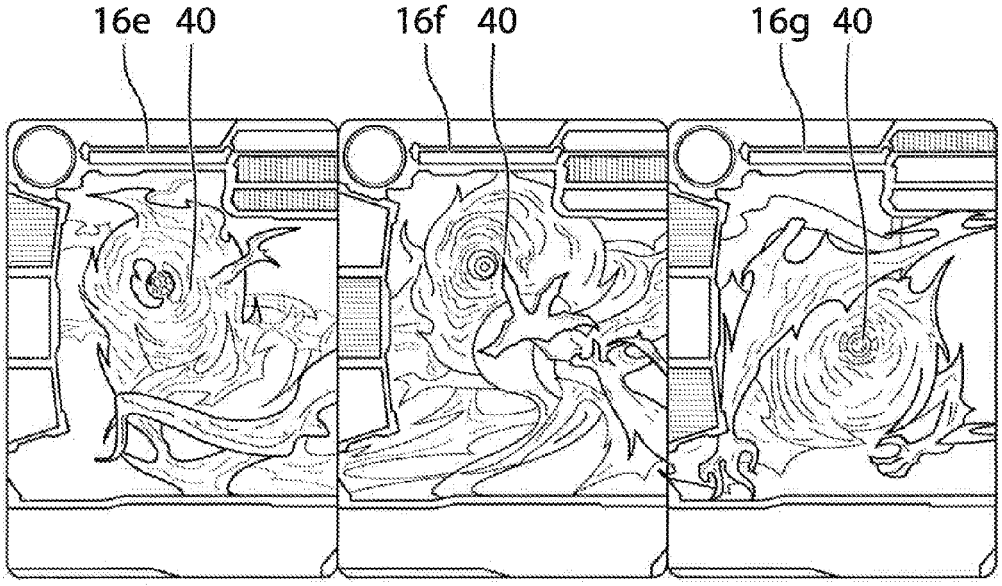
FIG. 15 is an exploded perspective view showing another three attack game pieces that cooperate together to form a combination attack.

An optionally provided type of attack is illustrated in FIG. 15. In FIG. 15, three attack game pieces 16*e*, 16*f* and 16*g* are shown which cooperate with each other, such that when they are positioned adjacent one another, their graphical representations 40 align to show a single composite image of an enhanced type of attack. These three attack game pieces 16*e*, 16*f* and 16*g* would be laid down on top of the opponent's three character game pieces 14 that are in play. The character game pieces 14 may be arranged as shown in FIG. 9. In embodiments wherein this type of enhanced attack is provided, the three character game pieces 14 that each player has should be positioned immediately adjacent one another so that this enhanced attack appears as one image and thus has a strong visual impact. The rules of play can be made so that if this kind of enhanced attack is used, it can be a stronger attack than if the three game pieces 16*e*, 16*f* and 16*g* were played at separate times. A variant of this would be to have enhanced attacks that include two attack game pieces 16 that together form a composite image of the enhanced attack. Other variants, using more than three attack game pieces 16 are also possible in embodiments wherein each player has more than three character game pieces 14 in play.

At some point if all of the bars of the parameter representation area 24 are covered by damage indicators 46, the value of that parameter is reduced to zero. If that parameter is health, it may mean that the character is defeated, (ie. is no longer in play), in some embodiments of the game.

If all of the characters of a player are defeated, then the player loses. In other words a player wins by defeating all of the characters of their opponent. In some embodiments, a player may also win if their opponent must draw an action game piece from their deck 84 but has no cards remaining in their deck 84.

The set 10 of game pieces described herein has associated therewith several advantages over the prior art not already stated. One advantage in particular is that the game can be played without requiring any paper at all. All of the information that is necessary to know is concerning the state of a character is shown right on the stack associated with that character. This includes the amount of damage that has been incurred by the character, updates to the character's defense strength values, special abilities associated with the character (described in the textual information 36) and updates to those abilities.

Another advantage provided by the set 10 of game pieces is that the amount of damage incurred by the character, or alternatively, the amount of a selected parameter that the character has remaining, is shown graphically in similar fashion to a power bar that is used in a video game. This is particularly useful for providing at-a-glance information to a player and also gives the game a modern feel by providing dynamic visual effects (ie. a graphic display that changes over time) that are typically associated with electronic devices.

The method of game play described above and the rules applicable to the use of the game pieces and energy tokens may be provided in a set of instructions that accompanies the set of game pieces.

The game pieces 16 have been described as attack game pieces, and they have included damage indication areas 44 including a damage indicator 46. It is possible, however, for the game pieces 16 to cause some other kind of effect instead of an attack-related effect. For example, the game pieces 16 could in some embodiments represent food, love, medicine, an increase in mental capacity, or friendship, for example, in a game where those types of effects can be played or applied on a character. In certain of these embodiments, these types of game pieces 16, may more broadly be referred to as parameter impact game pieces. These game pieces 16 could be used to impact any suitable parameter of a character, such as the health of the character, the intelligence of the character, the happiness of the character, the skill of the character at some task, or the like. Thus, the game pieces 16 may be said to have parameter impact indication areas 44 with parameter impact indicators 46 instead of damage indication areas 44 with damage indicators 46.

Additionally, such a game piece 16 would more broadly be considered to have a parameter impact representation area 38 which has a graphical representation of a type of parameter impact (e.g. hearts to represent love), instead of an attack representation area which has a graphic representation of an attack.

In the figures, the game pieces 14, 16 and 18 have been shown to be generally rectangular in shape. It will be understood that some or all of the game pieces 14, 16 and 18 may have other shapes, such as triangular shapes, circular shapes, hexagonal shapes, irregular shapes or other shapes. The game pieces 14, 16 and 18 may be referred to as cards, or they may be referred to simply as stackable members, which would encompass cards and other items that might not be considered cards by some persons. The term 'stackable members' is also intended to encompass items 14, 16 and 18 that may not necessarily be used in game play. For instance, people may acquire these stackable members 14, 16 and 18 and simply stack them for personal entertainment without necessarily playing a game. These stackable members 14, 16 and 18 may be collectible, in the sense that people may acquire numbers of them by purchasing them or bartering for them or competing for them or the like.

In some embodiments, such as embodiments wherein the members 14, 16 and 18 are stackable members without necessarily being used to play a game, the character member 14 need not have a parameter representation area 24. Furthermore, the stackable member 14 need not represent a character. Instead it could represent some object (e.g. a treasure chest, an item of food), a place (e.g. Canada, the Atlantic Ocean, Mars), or a concept (e.g. the human mind, life, friendship). Thus, instead of referring to the stackable member 14 as a character member 14, it could be more broadly referred to as a base stackable member, since it would have other stackable members 16 laid down on top of it. Furthermore, particularly in embodiments wherein the stackable members 14 and 16 are not used to play a game but are simply used for personal entertainment for example, the stackable members 16 may be used to show an effect on the base stackable member 14, wherein the effect does not necessarily impact any parameter of the base stackable member. For example, the base stackable member 14 may have a graphical representation of the country of Canada, and the stackable members 16 may have a graphic representation thereon representing snow. When the stackable member 16 would be stacked on top of the base stackable member 14 it would show snow superimposed over certain parts of Canada. Where a lenticular lens is formed on the upper surface of the stackable member 16, the graphical representation of the snow may be animated so that as a user changes their angle of view, it would appear to be snowing on the graphic representation of Canada. The stackable members 16 may thus more broadly be referred to as effect stackable members 16 instead of parameter impact stackable members 16.

While the above description constitutes a plurality of embodiments of the present invention, it will be appreciated that the present invention is susceptible to further modification and change without departing from the fair meaning of the accompanying claims.

We claim:

1. A set of game pieces, comprising:

a character game piece, wherein the character game piece includes a character representation area which includes a graphical representation of a character, wherein the character game piece includes a parameter representation area that includes a graphical representation of a parameter for the character;

a first parameter impact game piece, wherein the first parameter impact game piece has a parameter impact indication area that includes a first parameter impact indicator and a first generally transparent portion;

a second parameter impact game piece, wherein the second parameter impact game piece has a parameter impact indication area that includes a second parameter impact indicator and a second generally transparent portion, wherein when the parameter impact indication areas of the first and second parameter impact game pieces are stacked on top of the parameter representation area of the character game piece the first and second parameter impact indicators overlie at least a portion of the parameter representation area of the character game piece thereby indicating a level of parameter impact to the parameter that is greater than would be indicated by placing the parameter impact indication area of only one of the first or second parameter impact game pieces alone on top of the parameter representation area of the character game piece; and a third parameter impact game piece, wherein the third parameter impact game piece includes a parameter impact representation area which includes a graphical representation of a type of parameter impact and a generally transparent portion such that superposition of the parameter impact representation area of the parameter impact game piece on the character representation area of the character game piece shows the graphical representation of the character under the graphical representation of the type of parameter impact thereby illustrating graphically the parameter impact being carried out on the character, wherein the graphical representation of the type of parameter impact changes in appearance to reveal an animation related to the type of parameter impact, based on the angle of viewing by a player.

2. A set of game pieces as claimed in claim 1, wherein when the second parameter impact game piece overlies the first parameter impact game piece the first parameter impact indicator is visible through the second generally transparent portion.

3. A set of game pieces as claimed in claim 1, wherein the first and second parameter impact indicators are bars of a different colour than the parameter representation area.

4. A set of game pieces as claimed in claim 1, wherein the parameter impact representation area and the parameter impact indication area on each parameter impact game piece are positioned such that each parameter impact game piece is stackable on the character game piece such that the parameter impact representation area is superimposed on the character representation area and the parameter impact indication area is superimposed on the parameter representation area.

5. A set of game pieces as claimed in claim 1, wherein the parameter represented by the parameter representation area is the health of the character and wherein the parameter impact game pieces are attack game pieces and the parameter impact indicators represent impacts on the health of the character.

6. A set of game pieces, comprising:

a plurality of character game pieces, wherein each character game piece includes a character representation area which includes a graphical representation of a character; and a plurality of parameter impact game pieces, wherein each parameter impact game piece includes a parameter impact representation area which includes a graphical representation of a type of parameter impact and a generally transparent portion such that superposition of the parameter impact representation area of one of the parameter impact game pieces on the character representation area of one of the character game pieces shows the graphical representation of the character under the graphical representation of the type of parameter impact thereby illustrating graphically the parameter impact being carried out on the character, wherein the graphical representation of the type of parameter impact changes in appearance to reveal an animation related to the type of parameter impact, based on the angle of viewing by a player.

7. A set of game pieces as claimed in claim 6, wherein each parameter impact game piece includes a lenticular lens superimposed on the graphical representation of the type of parameter impact, wherein the lenticular lens changes the appearance of the graphical representation of the type of parameter impact based on the angle of viewing by a player.

8. A set of game pieces as claimed in claim 6, wherein superposition of a plurality of parameter impact game pieces on one of the character game pieces shows the graphical representation of the character under the graphical representations of the types of parameter impact and shows each of the graphical representations of the types of parameter impact, thereby revealing a chronology of parameter impact carried out on said one of the character game pieces.

9. A set of game pieces as claimed in claim 6, wherein the graphical representation of the type of parameter impact is a graphical representation of an attack.

10. A set of game pieces, comprising:

a plurality of character game pieces, wherein each character game piece includes a character representation area which includes a graphical representation of a character; and a plurality of parameter impact game pieces, wherein each parameter impact game piece includes a parameter impact representation area which includes a graphical representation of a type of parameter impact and a generally transparent portion such that superposition of the parameter impact representation area of one of the parameter impact game pieces on the character representation area of one of the character game pieces shows the graphical representation of the character under the graphical representation of the type of parameter impact thereby illustrating graphically the parameter impact being carried out on the character, wherein each parameter impact game piece includes a lenticular lens superimposed on the graphical representation of the type of parameter impact, wherein the lenticular lens changes the appearance of the graphical representation of the type of parameter impact based on the angle of viewing by a player.

11. A set of game pieces as claimed in claim 10, wherein superposition of a plurality of parameter impact game pieces on one of the character game pieces shows the graphical representation of the character under the graphical representations of the types of parameter impact and shows each of the graphical representations of the types of parameter impact, thereby revealing a chronology of parameter impact carried out on said one of the character game pieces.

12. A set of game pieces as claimed in claim 10, wherein the graphical representation of the type of parameter impact is a graphical representation of an attack.

13. A set of game pieces, comprising:

a character game piece, wherein the character game piece includes a character representation area which includes a graphical representation of a character, wherein the character game piece includes a parameter representation area that includes a graphical representation of a parameter for the character;

a first parameter impact game piece, wherein the first parameter impact game piece has a parameter impact indication area that includes a first parameter impact indicator and a first generally transparent portion;

a second parameter impact game piece, wherein the second parameter impact game piece has a parameter impact indication area that includes a second parameter impact indicator and a second generally transparent portion, wherein when the parameter impact indication areas of the first and second parameter impact game pieces are stacked on top of the parameter representation area of the character game piece the first and second parameter impact indicators overlie at least a portion of the parameter representation area of the character game piece thereby indicating a level of parameter impact to the parameter that is greater than would be indicated by placing the parameter impact indication area of only one of the first or second parameter impact game pieces alone on top of the parameter representation area of the character game piece; and a third parameter impact game piece, wherein the third parameter impact game piece includes a parameter impact representation area which includes a graphical representation of a type of parameter impact and a generally transparent portion such that superposition of the parameter impact representation area of the parameter impact game piece on the character representation area of the character game piece shows the graphical representation of the character under the graphical representation of the type of parameter impact thereby illustrating graphically the parameter impact being carried out on the character, wherein the third parameter impact game piece includes a lenticular lens superimposed on the graphical representation of the type of parameter impact, wherein the lenticular lens changes the appearance of the graphical representation of the type of parameter impact based on the angle of viewing by a player.

* * * * *